US006293830B1

(12) United States Patent
Park et al.

(10) Patent No.: US 6,293,830 B1
(45) Date of Patent: Sep. 25, 2001

(54) TERMINAL CONNECTING DEVICE HAVING A RESTRAINING STRUCTURE

(75) Inventors: Sang-Joong Park; Sung-Ki Seo; Ki-Dong Park, all of Kyungki-do; Sang-Cheul Lee, Seoul; Hyoung-Bin Lee, Kyungki-do; Young-Min Kim, Kyungki-do; Ho-Keun Oh, Kyungki-do; Ki-Sung Kim, Kyungki-do, all of (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/495,936

(22) Filed: Feb. 2, 2000

(30) Foreign Application Priority Data

Jul. 21, 1999 (KR) ..... 99-29475

(51) Int. Cl.[7] ..... H01R 4/38
(52) U.S. Cl. ..... 439/801; 439/709
(58) Field of Search ..... 439/701, 709, 439/710, 766, 801, 808, 809, 811, 812, 813, 816, 712, 714, 724, 715

(56) References Cited

U.S. PATENT DOCUMENTS 3,539,977 * 11/1970 Woertz ..... 439/811
4,669,806 * 6/1987 Fuchs ..... 439/712
4,832,628 * 5/1989 Huska ..... 439/716

FOREIGN PATENT DOCUMENTS 03-200231 * 3/1991 (JP) ..... H01R/4/38
04-11988 * 3/1992 (JP) ..... H01R/9/22

* cited by examiner

*Primary Examiner*—Tulsidas Patel
(74) *Attorney, Agent, or Firm*—Jones Volentine P.L.

(57) ABSTRACT

A terminal connecting device includes a main body of a terminal block having diaphragms and supporting strips, a terminal plate positioned at the top of the supporting strips, movable terminals supported by a spring to attach or detach lead wire positioned on the terminal plate, a restraining structure, proximate to the movable terminals, which limits the movement of the lead wire, and a terminal screw coupled with the movable terminals after being penetrated through the through hole of the lead wire and fastened at a screw hole of the terminal plate. The restraining structure restricts the lead wire from diverting or dropping, thereby preventing safety accidents such as stopping the operation of facility or electric shock. The restraining structure also allows easy penetration of the terminal screw through the through hole of the lead wire in fixing the lead wire, thereby improving productivity due to ease of fastening the terminal screw. The restraining structure may be extending parts extending from the movable parts or hitching jugs protruding at both lateral surfaces of the main body.

4 Claims, 5 Drawing Sheets

TERMINAL CONNECTING DEVICE HAVING A RESTRAINING STRUCTURE

CROSS-REFERENCES TO RELATED APPLICATIONS

The present application claims priority under 35 U.S.C. §119 to Korean Patent Application No. 99-29475 filed on Jul. 21, 1999, the entire contents of which are hereby incorporated by reference for all purposes.

BACKGROUND OF THE INVENTION

1. Field of the Invention

The present invention relates to a terminal connecting device for fixing a lead wire onto a terminal block, and more particularly to a terminal connecting device which can prevent the lead wire from diverting or dropping out of a terminal screw before or after the lead wire gets fixed onto the terminal block.

2. Description of the Related Art

In general, a terminal connecting device is used to electrically connect an external lead wire to an electromagnetic switch, an electromagnetic contact, an overload electromagnetic relay, a relay, a timer, a switch and so on.

FIG. 1 shows a terminal block disclosed in Japanese patent publication No. Heisei 03-2003 1. In FIG. 1, diaphragms 11, 11*a* are formed at the center of one side of a main body of a terminal block, and supporting parts 12, 12*a* protrude at both sides of the diaphragms. A plate spring 13 is coupled with the diaphragm 11*a*. A terminal plate 14 having a screw hole 14*a* is positioned at the top of the supporting parts 12, 12*a*.

A pair of movable terminals 15, 15*a* are elastically supported by a lower end of the plate spring 13 which is fastened to the terminal plate 14. The movable terminals 15, 15*a* are coupled with a terminal screw 17 which penetrates through the end of a lead wire and fastens at the screw hole 14*a* of the terminal plate 14.

Therefore, a lead wire 16 is positioned on the terminal plate 14 with the movable terminals 15, 15*a* being raised. After the movable terminals 15, 15*a* are lowered, the terminal screw 17 is fastened at the screw hole 14*a*. As a result, the lead wire 16 is fixed between the movable terminals 15, 15*a* and the terminal plate 14.

However, to raise the movable terminals in this configuration, a worker needs to lift up the movable terminals to a predetermined height. This complicates the assembly procedure and makes it difficult to accurately position the through hole of the lead wire onto the terminal screw and the screw hole. If the lead wire is fixed without confirming that the terminal screw completely penetrates the through hole, external factors, like vibration or impact, may divert or drop the lead wire out of terminal plate. If the lead wire diverts or drops out of the terminal plate, serious safety accidents, such as stopping operation of facility or electric shock, may occur.

In order to solve the aforementioned problems, a terminal block device has been disclosed in Japanese patent publication No. Heisei 04-11988, as shown in FIG. 2. In FIG. 2, diaphragms 21, 21*a* are formed at one side of the center of a main body 20 of the terminal block. Supporting parts 22, 22*a* and coil springs 23, 23*a* are positioned at both sides of the diaphragm 21*a*.

A terminal plate 24 having a screw hole 24*a* is positioned over the supporting parts 22, 22*a*, and a pair of movable terminals 25, 25*a* are assembled with their upper ends being coupled with the upper ends of the coil springs 23, 23*a*.

A terminal screw 27 is coupled at the movable terminals 25, 25*a* after penetrating through a screw hole 24*a* of the terminal plate. If the movable terminals 25, 25*a* are pressed with the end of the lead wire 26 being positioned over the terminal plate 24, the coil springs 23, 23*a* are compressed down to thereby drop the movable terminals 25, 25*a*. At this time, the terminal screw 27 is fastened, and the terminal screw 27 penetrating through a through hole of the lead line 26 is further fastened at the screw hole 24*a* of the terminal plate 24. As a result, the lead wire 26 is finally fixed.

This configuration thus solves the difficulty of lifting up the movable terminals to a predetermined height by raising the movable terminals with the elasticity of coil spring. However, even in this configuration, it is still difficult to get the terminal screw to penetrate through the through hole of the lead wire and fastened at the screw hole. Particularly, when the terminal screw is fastened without passing through the through hole of the lead wire, the lead wire positioned between movable terminals and the terminal plate may divert or drop out of the terminal plate by any external factor, such as vibration or impact, which may result in safety accidents like stopping operations of facility or electric shock.

SUMMARY OF THE INVENTION

Therefore, it is an object of the present invention to solve the aforementioned problems of the related art and provide a terminal connecting device which can readily get a lead wire fixed at a terminal screw.

It is another object of the present invention to provide a terminal connecting device which prevents the lead wire coupled between a terminal plate and movable terminals from diverting or dropping.

In order to accomplish at least one of the aforementioned and other objects of the present invention, there is provided a terminal connecting device including a main body of a terminal block having diaphragms and supporting strips, a terminal plate positioned at the top of the supporting strips, movable terminals supported by a spring to attach or detach lead wire positioned on the terminal plate, a restraining structure, proximate to the movable terminals, which limits the movement of the lead wire, and a terminal screw coupled with the movable terminals after being penetrated through the through hole of the lead wire and fastened at a screw hole of the terminal plate. The restraining structure may be extending parts extending from the movable parts or hitching jugs protruding at both lateral surfaces of the main body.

Further, in order to accomplish at least one of the aforementioned and other objects of the present invention, there is provided a method of fastening a lead wire having a through hole to a terminal plate including inserting the lead wire through a restraining structure proximate to movable terminals supported by a spring to attach or detach the lead wire to a main body of a terminal block having diaphragms, supporting strips and a terminal plate positioned at the top of the supporting strips, inserting a terminal screw coupled with the movable terminals through the through hole of the lead wire, and fastening the terminal screw having been inserted through the through hole of the lead wire at a screw hole of the terminal plate. The inserting the lead wire through a restraining structure may include positioning the lead wire through extending parts extending from a receiving side of the movable terminals or positioning the lead wire through hitching jugs formed at both lateral surfaces of the main body.

The restraining structure of the present invention restricts the lead wire from diverting or dropping, thereby preventing safety accidents such as stopping the operation of facility or electric shock. The restraining structure of the present invention also allows easy penetration of the terminal screw through the through hole of the lead wire in fixing the lead wire, thereby improving productivity due to ease of fastening the terminal screw.

These and other objects of the present invention will become more readily apparent from the detailed description given hereinafter. However, it should be understood that the detailed description and specific examples, while indicating the preferred embodiments of the invention, are given by way of illustration only, since various changes and modifications within the spirit and scope of the invention will become apparent to those skilled in the art from this detailed description.

BRIEF DESCRIPTION OF THE DRAWINGS

Other objects and aspects of the invention will become apparent from the following description of embodiments with reference to the accompanying drawings in which.

DETAILED DESCRIPTION OF THE PRESENT INVENTION

Figure 1:
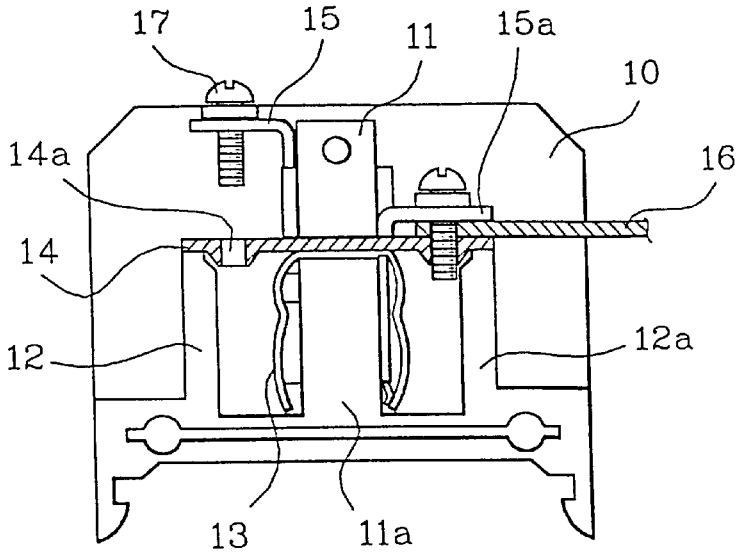
Fig.1(PRIOR ART)
FIG. 1 is a front view for illustrating an embodiment of a conventional terminal connecting device.
Figure 2:
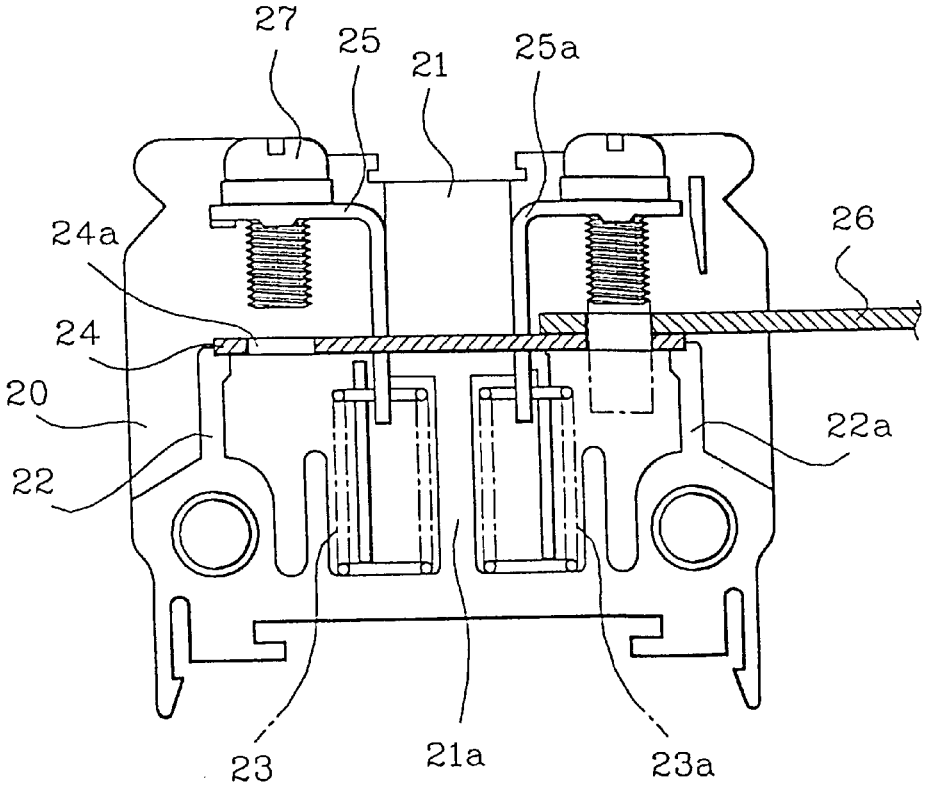
Fig.2(PRIOR ART)
FIG. 2 is a front view for illustrating another embodiment of a conventional terminal connecting device.

Preferred embodiments of the present invention will be described in detail with reference to accompanying drawings. Like reference numerals are used to refer to like elements.

Figure 3:
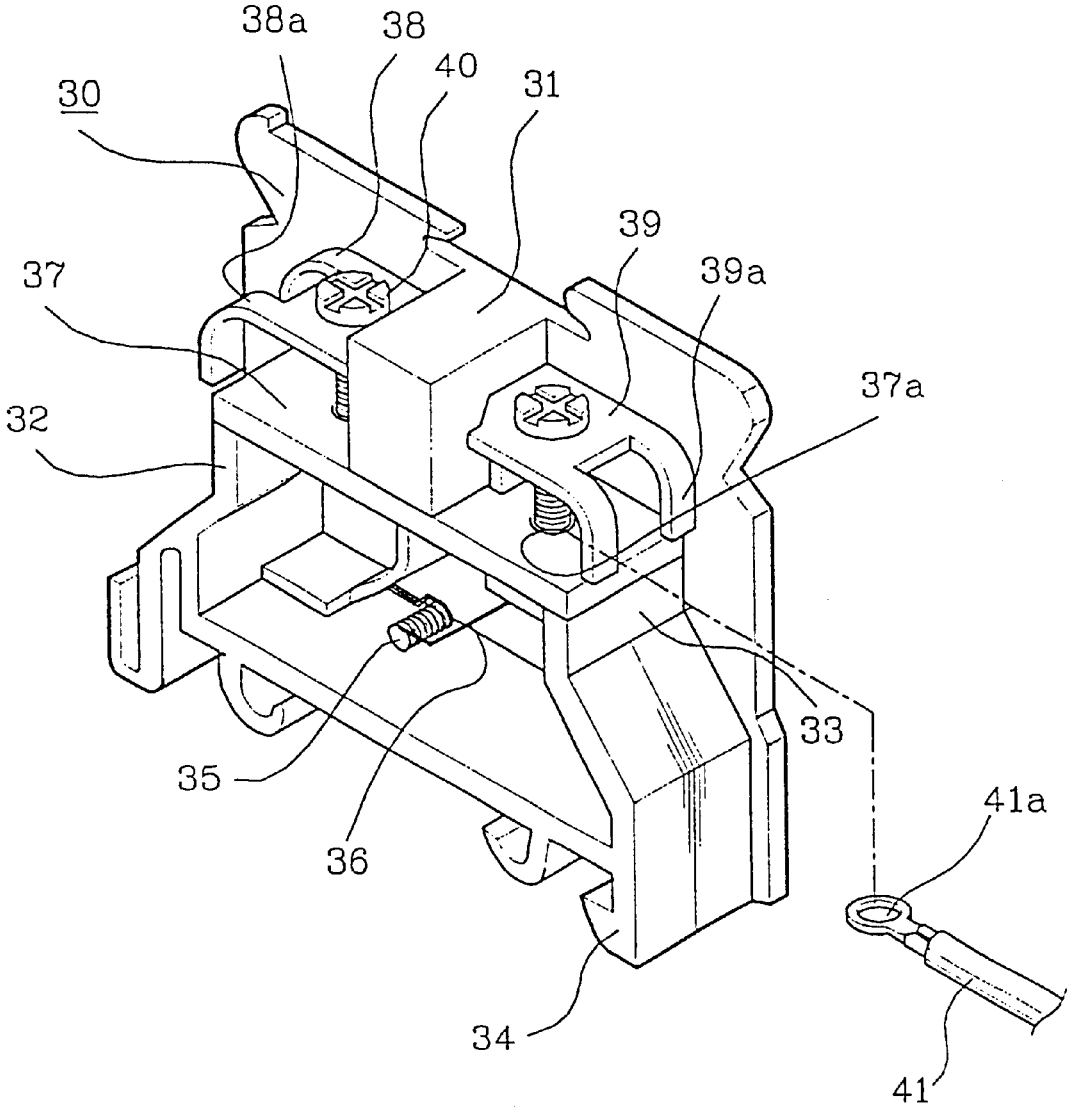
FIG. 3 is an elevational perspective view for illustrating a terminal connecting device in accordance with an embodiment of the present invention.

FIG. 3 is an elevational perspective view illustrating a terminal connecting device in accordance with the present invention including a main body 30 of a terminal block of non-conducting material like a synthetic resin.

A diaphragm 31 is formed at an upper center portion of one side of the main body 30, and supporting strips 32, 33 are formed at both lower sides of the main body 30. A plurality of rails (not shown) can be mounted in single or multiple lines on the main body 30 of the terminal block. A mounting part 34 is formed at a lower portion of the supporting strips 32,33 to mount the main body 30 onto the rails (not shown). The rails (not shown) would extend through the features provided on the mounting part 34. A fixing pin 35 protrudes between the supporting strips. A spring 36 is provided at the fixing pin 35.

A terminal plate 37 having a screw hole 37*a* is secured at the supporting strips 32, 33.

Movable terminals 38, 39 are assembled with their lower sides being supported upward by elasticity of the spring 36. A terminal screw 40 is coupled with the movable terminals 38, 39 to get fastened at the screw hole 37*a* of the terminal plate 37.

Extending parts 38*a*, 39*a* are bent downward at both movable terminals 38, 39. The length of the extending parts 38*a*, 39*a* should be adjusted so that their ends do not touch the lower external surface of the supporting strips 32, 33 when a lead wire 41 positioned between terminal plate 37 and movable terminals 38, 39 is fastened with the terminal screw 40. In other words, the extending parts 38*a*, 39*a* should be shorter than the supporting strips 32, 33.

The extending parts 38*a*, 39*a* prevent the lead wire 41 positioned between terminal plate 37 and movable terminals 38, 39 from diverting or dropping at random. At the same time, the extending parts 38*a*, 39*a* guide the lower end of the terminal screw 40 to pass through the through hole 41*a* of the lead wire 41.

Figure 4:
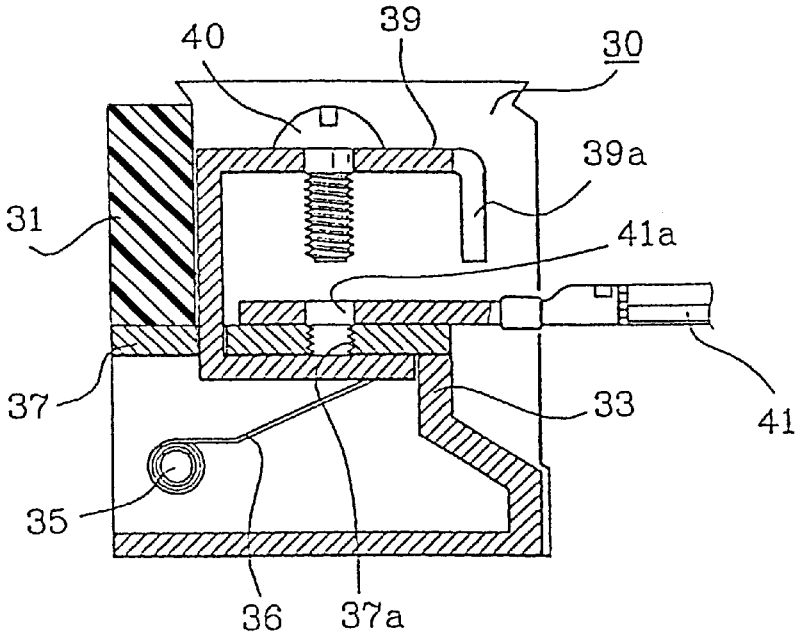
FIG. 4 is a partial enlarged sectional view for illustrating a part shown in FIG. 3.

In the terminal connecting device thus constructed, the lead wire 41 is placed on the terminal plate 37, as shown in FIG. 4, and the movable terminals 38, 39 are lowered down to get the lead wire 41 fastened with the terminal screw 40. As a result, the lead wire 41 is finally fixed.

If the movable terminals 38, 39 are lowered down with the lead wire 41 being closely attached at the upper surface of the terminal plate 37, the spring 36 coupled with the fixing pin 35 is compressed. At the same time, the extending parts 38*a*, 39*a* formed at the movable terminals 38, 39 are lowered down, thereby preventing lead wire 41 from diverting or dropping out of terminal plate.

Figure 5:
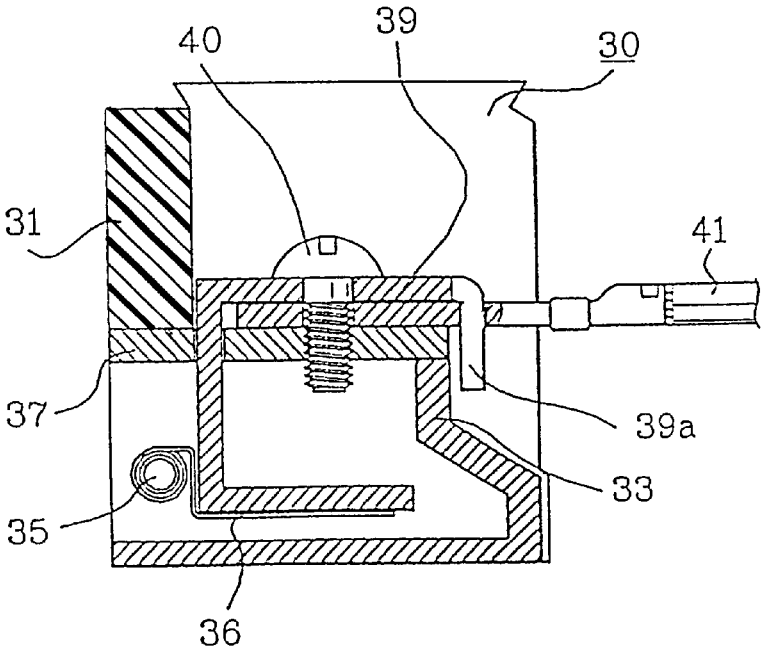
FIG. 5 is a partial enlarged sectional view for illustrating an assembling state of the terminal connecting device in accordance with an embodiment of the present invention.

Furthermore, if the movable terminals 38, 39 are lowered down, the extending parts 38*a*, 39*a* guide the lead wire 41 to get the end of the terminal screw 40 to penetrate through the through hole 41*a* of the lead wire 41. Accordingly, an end of the lowering terminal screw 40 passes through the through hole 41*a* to thereby be positioned over the screw hole 37*a*. At this time, the terminal screw 40 is fastened at the screw hole 37*a*. Then, as shown in FIG. 5, the lead wire 41 is finally fixed.

Figure 6:
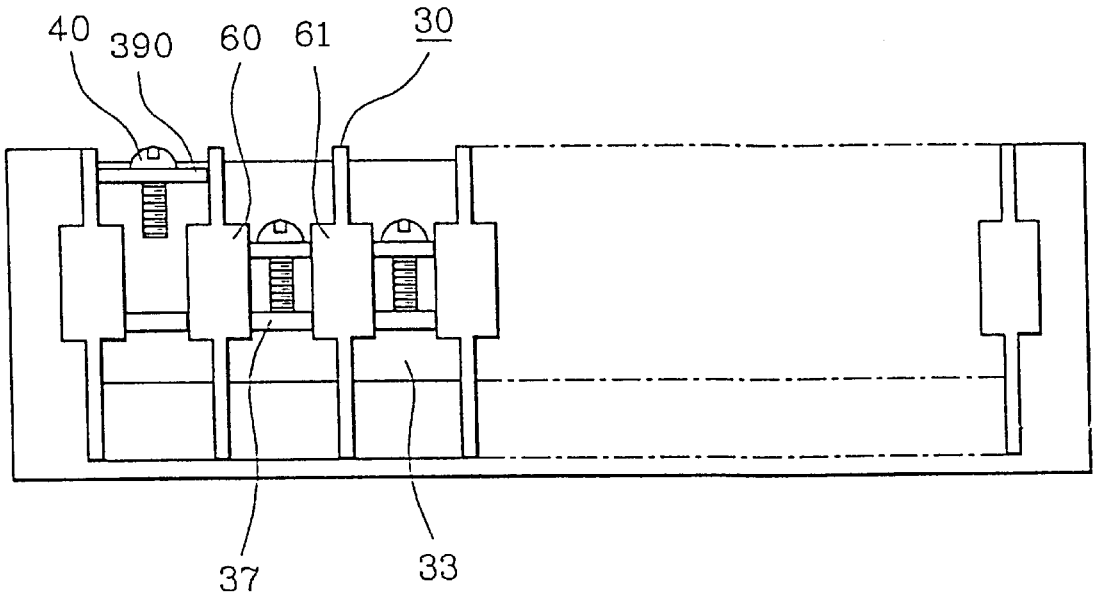
FIG. 6 is a partial front view for illustrating a terminal connecting device in accordance with another embodiment of the present invention.
Figure 7:
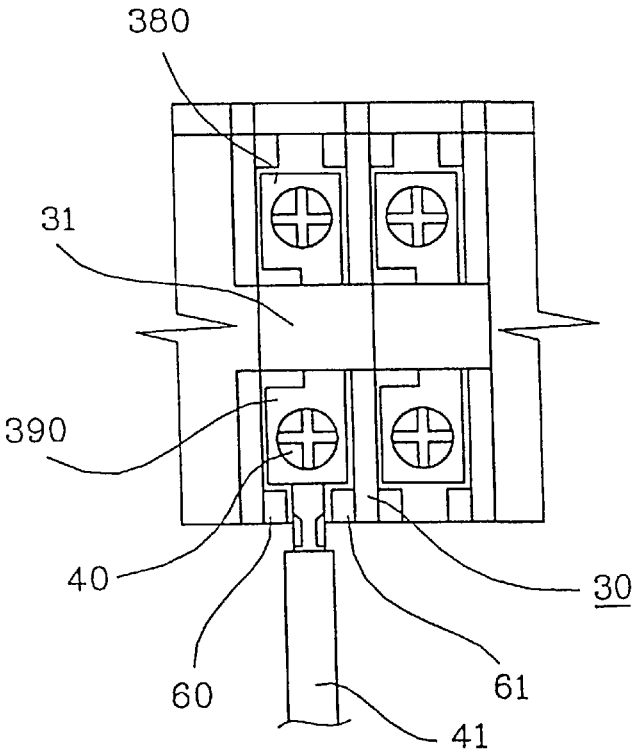
FIG. 7 is a plane view of FIG. 6.
Figure 8:
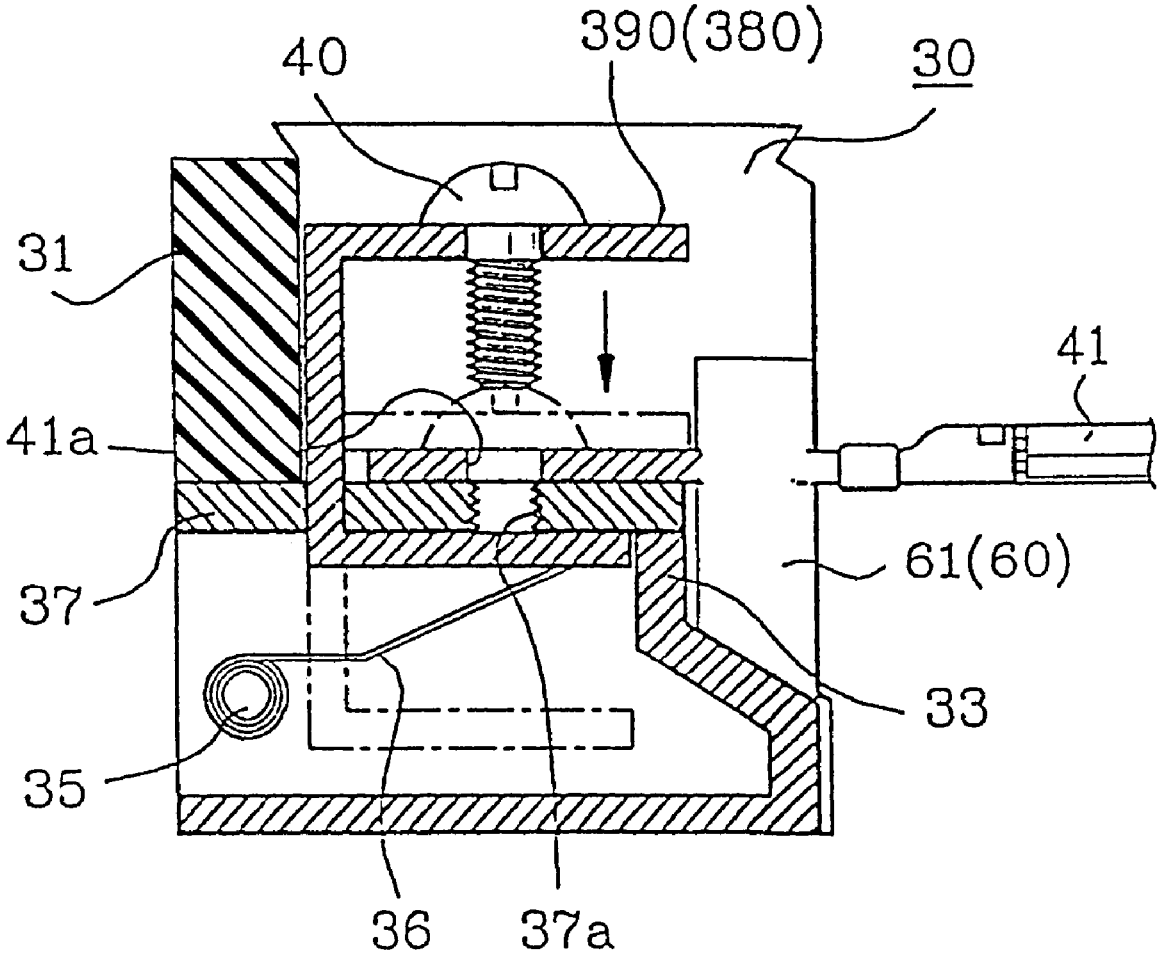
FIG. 8 is a partial enlarged sectional view for illustrating an assembling state of the terminal connecting device in accordance with another embodiment of the present invention.

Another embodiment of a terminal connecting device of the present invention is shown in FIGS. 6 through 8. FIGS. 6 through 8 are respectively a partial front view, a plane view and a partial sectional view of the terminal connecting device of this embodiment. In the drawings for this embodiment, the same reference part names and symbols will be used in the same structure as in the aforementioned embodiment, and detailed descriptions will be omitted thereto.

In the FIGS. 6–8, hitching jugs 60, 61 protrude at both lateral surfaces of the main body 30 relevant to external sides of the movable terminals 380, 390 which are raised and dropped by the supporting spring 36 in FIG. 6. The hitching jugs 60, 61 may be integrally formed with the main body 30 or separately manufactured and attached to the main body 30 with an adhesive. In the terminal connecting device thus constructed, the hitching jugs 60, 61 protruding at both lateral surfaces of the main body 30 are used for preventing the lead wire 41 from diverting or dropping out of the terminal plate 37.

In other words, as shown in the sectional view of FIG. 8, the lead wire 41 is positioned upward over the hitching jugs 60, 61 to be over the terminal board 37. Then, the movable terminals 380, 390 are lowered down, so that the end of the terminal 40 is penetrated through the through hole 41*a* of the lead wire 41 by the hitching jugs 60, 61. At this time, if the terminal screw 40 is fastened at the screw hole 37*a*, the lead wire 41 is finally fixed. The hitching jugs 60, 61 also guide the lead wire 41 into proper fastening position at the terminal screw.

Therefore, the hitching jugs 60, 61 prevent the lead wire 41 from diverting or dropping out of the terminal plate 37. In addition, the hitching jugs 60, 61 guide the end of the screw 40 to penetrate through the through hole 41*a* of the lead wire 41. The hitching jugs 60, 61 also help the terminal screw 40 get fastened at the screw hole 37*a*.

Therefore, there are advantages of the terminal connecting devices of the present invention in that extending parts formed at the movable terminals or hitching jugs protruding at both lateral surfaces of the main body prevent the lead wire from diverting or dropping out of the terminal plate due to external vibration or impact when or after the lead wire is fixed, thereby preventing safety accidents such as stopping the operation of facility or electric shock. These constraining structures also the terminal screw to be easily inserted through the through hole of the lead wire in fixing the lead wire, thereby improving productivity due to ease of fastening the terminal screw.

While the present invention is described herein with reference to illustrative embodiments for particular applications, it should be understood that the present invention is not limited thereto. Those having ordinary skill in the art and access to the teachings provided herein will recognize additional modifications, applications, and embodiments within the scope thereof and additional fields in which the invention would be of significant utility without undue experimentation. Thus, the scope of the invention should be determined by the appended claims and their legal equivalents, rather than by the examples given.

What is claimed is:

1. A terminal connecting device comprising:

a main body of a terminal block having diaphragms and supporting strips;

a terminal plate positioned at the top of the supporting strips;

movable terminals supported by a spring to attach or detach a lead wire positioned on the terminal plate;

a restraining structure proximate to said movable terminals which restricts movement of the lead wire in a direction opposite to an insertion direction of the lead wire onto the terminal plate, wherein said restraining structure comprises hitching jugs formed at both lateral surfaces of the main body; and a terminal screw coupled with a corresponding movable terminal after being penetrated through a through hole of the lead wire and fastened at a screw hole of the terminal plate.

2. The device as defined in claim 1, wherein the hitching jugs are integrally formed at the terminal block.

3. The device as defined in claim 1, wherein the hitching jugs are separately manufactured and attached to the terminal block with an adhesive.

4. The device as defined in claim 1, wherein a number of the hitching jugs is at least more than one.

* * * * *